US007190322B2

(12) United States Patent
Apostolos et al.

(10) Patent No.: US 7,190,322 B2
(45) **Date of Patent: *Mar. 13, 2007**

(54) MEANDER LINE ANTENNA COUPLER AND SHIELDED MEANDER LINE

(75) Inventors: John T. Apostolos, Merrimack, NH (US); Patrick D. McKivergan, Londonderry, NH (US)

(73) Assignee: Bae Systems Information and Electronic Systems Integration Inc., Nashua, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/514,212

(22) PCT Filed: Oct. 31, 2003

(86) PCT No.: PCT/US03/34996

§ 371 (c)(1),
(2), (4) Date: Nov. 10, 2004

(87) PCT Pub. No.: WO2004/062033

PCT Pub. Date: Jul. 22, 2004

(65) Prior Publication Data

US 2005/0225496 A1 Oct. 13, 2005

Related U.S. Application Data

(63) Continuation of application No. 10/378,336, filed on Mar. 3, 2003, now Pat. No. 6,894,656.

(60) Provisional application No. 60/435,099, filed on Dec. 20, 2002.

(51) Int. Cl.
*H01Q 1/52* (2006.01)

(52) U.S. Cl. ..... 343/841; 343/745

(58) Field of Classification Search ..... 343/741–745, 343/749, 850, 866–868, 841
See application file for complete search history.

(56) References Cited

U.S. PATENT DOCUMENTS 5,754,143 A * 5/1998 Warnagiris et al. ..... 343/767
6,489,925 B2 * 12/2002 Thursby et al. ..... 343/744
6,701,167 B2 * 3/2004 Odachi et al. ..... 455/575.7

* cited by examiner

*Primary Examiner*—Hoang V. Nguyen
*Assistant Examiner*—Ephrem Alemu
(74) *Attorney, Agent, or Firm*—Robert K. Tendler; Daniel J. Long

(57) ABSTRACT

A switched meander line structure is substituted for a lumped element antenna tuner for an order of magnitude increase in gain due to the use of the switched meander line architecture. The use of the meander line with relatively wide and thick folded legs markedly decreases $I^2R$ losses over wire inductors whose wire diameters at one-tenth of an inch contribute significantly to $I^2R$ losses. Additionally, placing solid state switches to short out various sections of a multi-leg meander line at high impedance nodes reduces $I^2R$ losses across the switching elements in the tuner.

27 Claims, 10 Drawing Sheets

MEANDER LINE ANTENNA COUPLER AND SHIELDED MEANDER LINE

This application is a 371 of PCT/US03/34996 filed on Nov. 3, 2003, which is a continuation of U.S. application Ser. No. 10/378,336 filed on Mar. 03, 2003 now U.S. Pat. No. 6,894,656 which claims priority of U.S. Provisional Application Ser. No. 60/435,099, filed Dec. 20, 2002.

FIELD OF THE INVENTION

This invention relates to antenna couplers and more particularly both to the utilization of a meander line architecture for providing the coupler and to a shielded meander line.

BACKGROUND OF THE INVENTION

Lumped element antenna couplers have been used in the past to efficiently couple energy into antennas whose impedance is not matched with that of the transmission line. Typically, transmission lines are 50-ohm devices and when using, for instance, whip or monopole antennas, these antennas typically have impedances at the base of the antenna at about 0.05 ohm in the high frequency or HF band. When the transmission line is matched to the impedance at the base of the antenna, the coupler limits the energy dissipated in resistive losses and maximizes the transmitted energy. so that the antenna can be easily excited and operated at or near resonance.

Thus, antenna couplers for monopole antennas are able to match the impedance at the feed of the antenna with that of the transmission line by raising its relatively low impedance to that of 50 ohms.

Moreover, not only does one have 0.05 ohms at the base of a whip or monopole, one has a relatively large reactance which must be canceled out for efficient transfer of energy from the signal source to the antenna. While the large reactance might typically be canceled out using a loading coil to cancel out the capacitive reactance, one nonetheless has to match whatever resistance is left to the 50-ohm impedance of the transmission line.

Typical antenna couplers in the past involving lumped elements include combinations of inductors and capacitors in either a T network or a pi network configuration. In order to change the inductance or capacitance so that the impedance at the feed of the antenna is matched to the impedance of the transmission line, originally inductors were mechanically tapped along their coils or capacitors were provided with variable capacitance plates. The inductance and the capacitance were varied mechanically in order to match antenna impedance to the impedance of the transmission line. However, for frequency-hopping applications in which the frequency of the source is switched in microseconds, it became necessary to utilize solid state switching in order to switch in or out various taps of a coil or in order to switch various capacitors in and out in time to accommodate the frequency change.

Problem with the utilization of such lumped elements center around $I^2R$ ohmic heating losses which result either from the relative thinness of the wire utilized in the inductors or internal resistance of the solid state switches. Moreover, since the solid state switching utilized in these couplers was placed at high-current nodes, oversized and expensive switches were required.

Thus, while mechanical switching was suitable some 40 years ago for antenna couplers, with the advent of frequency-hopping, it is too slow. There was therefore a need for rapid re-tuning of antenna couplers that required the use of solid state switching.

Regardless of whether solid state switches were used, the prior lumped element couplers resulted in $I^2R$ losses that in turn resulted in a 20 to 30 dB reduction in radiated power.

Since large amounts of power are lost in the inductors and the diode switches that switch in and out the capacitors and inductors, one requires a much more efficient coupling system. The ohmic losses are primarily due to the circulating currents in the elements that can rise to huge values to cause the high $I^2R$ ohmic losses. The only way one could reduce these losses with conventional lumped element couplers is to make the inductors and capacitors very big. One would therefore have to have a container that was perhaps three feet by three feet by three feet in order to attempt to limit the, ohmic losses. However, as one makes the inductors large, the Qs get too high, which results in extremely high voltages and even greater ohmic losses. Additionally, with the very high voltages involved with the large components, the diodes that are utilized in the solid state switching are heavily stressed. Thus, solid state switches for these larger units would have to be extremely massive and expensive.

For a reasonably-sized lumped element coupler operating, for instance, at 2 megahertz and feeding, for instance, a loop antenna having a six-foot radius corresponding to a whip on the back of the truck which has its tip bent and attached to the forward end of the truck, gains have been measured at −23 dBi. This means that a considerable amount of the power which should be coupled to the antenna is lost as heat in the antenna coupler. As will be seen hereinafter, substituting a switched meander line architecture for the lumped element coupler results in a −13 dBi overall gain, which is an improvement of 10 dB over the lumped element coupler. This corresponds-to an order of magnitude improvement.

SUMMARY OF INVENTION

Rather than utilizing a lumped element coupler, in the subject invention a meander line is substituted for the coupler. The meander line is a long, slow wave delay line folded on itself, with the diode switches being interposed to switch transmission line sections in and out to obtain the proper length for the matching of an arbitrary antenna to a particular transmission line impedance.

Typically, the folded sections of the meander line are made out of copper strips which may be one inch wide by one-tenth inch thick. The use of so much metal results in much less ohmic loss as compared with, for instance, Number 12 wire typically utilized in inductors for lumped element couplers.

Moreover, the circulating currents in the meander line are not very large so one does not have a lot of ohmic loss as compared with the ohmic loss associated with an inductor.

In one embodiment, the switching is made to occur at the high impedance points for the meander line so that very little current flows through the diode switches. This also limits the $I^2R$ losses.

It is a finding of this invention that regardless of the impedance of the antenna at its feed point, there are combinations of meander line segments that may be switched in and out to tailor the resistance and reactance of the meander line so that when it is coupled in parallel to the antenna resistance and reactance an antenna input impedance is created that matches the impedance of the transmission line.

Originally, it was not clear that any combination of meander line legs could be introduced that would match an arbitrary antenna impedance to a particular transmission line impedance. However, after experimentation it was found that, by switching in and out various segments of meander line, one could in fact match any arbitrary impedance to the impedance of the transmission line. The reason, it was found, is that the yet-to-be-determined input impedance of the antenna is proportional to the ratio of the square of the sum of the capacitive reactances of the meander line over the unloaded Q of the meander line. With the VSWR calculated, it was found that the total capacitive reactance decreases with frequency in synchronism with the unloaded Q of the meander line. This property accounts for the ability to maintain a good match over frequency as the meander line is tuned to achieve resonance by shorting out combinations of its sections.

As a result, the outstanding characteristic of the meander line-loaded antenna used as a coupler is that near the resonant frequency, the current distribution along its vertical and horizontal plates is highly peaked at the gap between the vertical and the horizontal plates. The gap region was found to harbor a parallel resonance formed by the meander line and the distributed capacitance between the horizontal and vertical plates and the impedance of the antenna, namely $R_A$, $X_A$. Thus, the meander line exhibited a parallel resonance effect. As a result, by coupling the meander line in parallel with the resistive and capacitance impedance of the antenna, one could tailor the impedance of the antenna input to match that of the transmission line.

Note that the slow wave meander line loaded antennas have been described before and are characterized in U.S. Pat. No. 5,790,080 incorporated herein by reference. This patent describes an antenna that includes one or more conductive elements acting as radiating antenna elements and a slow wave meander line adapted to couple electrical signals between the conductive elements. The meander line has an effective electrical length that affects the electrical length and operating characteristics of the antenna.

Meander lines are routinely connected between the vertical and horizontal conductors at a gap, with the meander line slow wave structure permitting lengths of meander line to be switched in or out of the circuit quickly and with negligible loss. In part, this switching is made possible because active switching devices are located at high-impedance sections of the meander line. This feature keeps the current through the switching devices low and results in very low dissipation losses in the switch, thereby maintaining high antenna efficiency.

The meander line loaded antenna allows the physical antenna dimension to be reduced significantly while maintaining an electrical length that is still a multiple of a quarter wavelength of the operating frequency.

U.S. Pat. No. 6,325,814 for wide band meander line loaded antennas is also included herein by reference. This reference discloses a meander line loaded antenna which provides a wide instantaneous bandwidth. A first planner conductor is substantially parallel to a ground plane and is separated from the first planner conductor by a gap, with the meander line interconnecting the first and second planner conductors.

Having described the existing meander line loaded antennas, it is the object of the present application to substitute a switched meander line for a lumped element antenna coupler, with the switched meander line constituting a variable-impedance transmission line. While balun coils have been utilized in the past to match antennas to transmission lines, the balun coils are not able to match an arbitrary impedance.

The purpose of the switched meander line in the subject invention is to take the antenna impedance and the meander line impedance and connect them in parallel, and then alter the impedance of the meander line so that the parallel combination of the two impedances provides a point that matches a predetermined transmission line impedance, such as 50 ohms. For any given frequency, it has been found that the parallel combination of the meander line impedance and the antenna impedance can be made to match the transmission line impedance and that, by adjusting the impedance of the meander line through the above-noted switching, one can always find a suitable match.

As will be further seen, it is possible to provide the meander line structure with a shield which, in addition to decreasing the low frequency cutoff of the device, also results in various sections of the meander line being high-impedance nodes at which one can place solid state diode switches, with the high-impedance nodes carrying virtually no current. The result is that one can fabricate an antenna coupler with relatively inexpensive solid state switches. Moreover, since $I^2R$ losses are minimized because of the heavy meander line elements and the low internal resistance of the switches, the meander line architecture provides an order of magnitude improvement in gain over lumped element couplers.

In summary, a switched meander line structure is substituted for a lumped element coupler for an order of magnitude increase in gain due to the use of the switched meander line architecture. The use of the meander line with relatively wide and thick folded legs markedly decreases $I^2R$ losses over wire inductors whose wire diameters contribute significantly to $I^2R$ losses. Additionally, placing solid state switches to short out various sections of a multi-leg meander line at high impedance nodes reduces $I^2R$ losses across the switching elements as well. It has been found that, regardless of the impedance of the antenna, this impedance may be matched by switching in and out various sections of a folded multi-leg meander line due to the fact that the square of the sum of the capacitive reactances of the meander line decreases with frequency in synchronism with the unloaded Q of the meander line, thus to provide the ability to maintain a good match over frequency as the meander line is tuned to achieve resonance by shorting out combinations of sections of the meander line. The result of the substitution of the meander line architecture for the lumped element coupler is the reduction of losses associated with the use of wire inductors and losses due to the interposition of solid state switches at high-current nodes.

Shielded Meander lines

More specifically and by way of further background, slow wave meander line loaded antennas are known, with the meander line providing for a narrow band and a wide band response, depending on the application. One patent describing such a slow wave meander line structure is U.S. Pat. No. 6,313,716 assigned to the assignee hereof and incorporated herein by reference. In this meander line embodiment, the meander line includes an electrically conductive plate, and a plurality of transmission line sections supported with respect to the conductive plate. The plurality of sections includes a first section loaded relatively closer and parallel to the conductive plate to have a relatively lower characteristic impedance with the conductive plate, and a second section located parallel to and at a relatively greater distance from the conductive plate than the first section to have a relatively higher characteristic impedance with the conductive plate. A conductor is provided for interconnecting the first and second sections and maintaining an impedance mismatch therebetween.

If one were to use the above meander line in a coupler in some applications one could use a wider band response in terms of decreased frequency cutoff. While meander lines are used to provide a compact or miniaturized device no matter what the frequency band, for each band obtaining a lower frequency cutoff is often important.

For instance, for low frequency communication in which a grounded loop antenna replaces the traditional whip antenna mounted to a vehicle, the ability to operate down to 4 MHz is vitally important. The low frequency requirement is to assure close-in sky wave communications by having the take-off angle as steep as possible. However, getting the meander line antenna coupler described above to operate at 4 MHz can be challenging. Either meander line couplers have to double their footprint or the antenna has to be elongated and may extend up too far, meaning it can get caught on trees or overhanging vegetation, to say nothing of low lying power or telephone lines.

Moreover, as described above, meander line couplers have various meander line sections switched in and out to change the frequency at which the meander line is tuned. Because the PIN diode or FET switches can be placed between a high impedance section of the meander line and a low impedance section, the open switch differential voltage across the switch may be in excess of 10,000 volts. This causes substantial voltage stress that can cause the switches to fail, which in turn limits the transmit power allowed so as not to burn out the switches. While in a tactical situation one might want to switch from 100 watts to 300 watts, switch failure would prevent one from so doing.

Going from military to civilian use, for the cellular and PCS bands it is important to provide a miniature wide band antenna that can operate between 800 and 3,000 MHz. Unfortunately it is only with difficulty that one can get below 1500 MHz using standard meander line loaded antennas. In short, for standard meander line loaded antennas there is a severe low frequency threshold. This limits how low a cutoff frequency for the meander line can be. What is needed is a breakthrough in the low frequency cutoff of meander line loaded antennas for such applications.

A third application is for military communications in the 30–88 MHz band. What is required is a reduced footprint antenna that is small enough to be carried on a vehicle or aircraft and yet operate in the 30–88 MHz band. Standard meander line loaded antennas, while small, are nonetheless too large at 30 MHz. Again, what is needed is a breakthrough in the lowering of the low frequency cutoff for meander line structures in the 30–88 MHz range so that a suitably sized device will work.

Whether it be for 4 MHz communications, 30 MHz communications or 800+ MHz communications, there is a need for a compact device having a reduced the low frequency cutoff. Note that a standard meander line coupler at 4 MHz would have a footprint of 28"×50", inconvenient to be placed on the top of a small vehicle. For the 30–88 MHz range a meander line loaded antenna would have to be as large as 16"×48"×48", again inconvenient for vehicle or aircraft use. In the cellular and PCS applications, meander line loaded antennas are only 0.3" high×1.2" wide×1.2" long. However, their low frequency cutoff is approximately 1500 MHz, too far above the cellular 800 MHz band.

What is therefore necessary is a new meander line configuration to dramatically lower the low frequency cutoff of such devices.

By way of further background, for military use, taking a tactical situation in which a soldier or vehicle needs to communicate with another soldier or vehicle at some distance away, typically communications is provided through the use of a ground wave and also from skip off the ionospheric layer. While a ground wave is usually viable up to about 30 miles from the transmission site, if the skip angle is shallow, there will be a significant blackout or dead zone along the ground, say from 30 miles to 100 miles, where there will be no communications possible. This is because the transmitted radiation skips over this ground segment before it is reflected down to the surface of the earth.

When depending on a sky wave or a skip for robust communications, the takeoff angle of the radiation is indeed important. It is noted that the higher the frequency the more shallow is the takeoff angle such that there is more of an extended dead zone which starts at the transmission site and extends to the point at which radiation reflected from the ionosphere strikes the surface of the earth. This means that there is a communications blackout zone, for instance, between 30 miles and 100 miles when a transmitter is operating in the 5 MHz frequency band. This is because of the somewhat shallow takeoff angle in which no radiation from the transmitter reaches a position on the surface of the earth beyond the point at which the ground wave dissipates. Thus in the above example, there would be no communication possible between 30 miles and 100 miles from the transmitter.

Were it possible to be able to lower the operating frequency of the transmitter to, for instance, 4 MHz, then the takeoff angle would be higher and radiation returned from the ionosphere would be closer to the transmitter, e.g. between 30–100 miles: of the transmitter. What this means is that communications could established from the transmitter all the way up to the 30 mile limit of the ground wave transmission and then up to another 100 miles due to the sharper skip angle involved with operating at the lower frequency.

While it is certainly possible with a long whip antenna to be able to transmit at 4 Mz, it would be desirable to be able to use a short radiator and a meander line structure as a miniature coupler to permit operating at 4 MHz. Thus, rather than having to have a quarter wave antenna at 4 MHz, one needs to find how to construct a miniaturized coupler for a very short length whip or loop. One therefore needs to develop a meander line coupling device that without enlarging the device would lower the VSWR to less than 2:1 at the lower frequency. This would permit a continuum in the communications capabilities of the transmitter while at the same time using a smaller radiator and the same miniaturized meander line coupler.

For 30–88 MHz use, this is a frequency hopping communications band used extensively by the military. The antenna structures for this band are sizeable and there is a need to be able to reduce the size of the antenna structures so that they can be readily mounted to vehicles or aircraft. While meander line couplers and antennas have been proposed for such use, they cannot be made to operate close to 30 MHz, at least at sizes that are required. To make such an antenna operate at 30 MHz the size required is a volume 16" high×48" wide×48" long, or 36,864 cubic inches. This resulted in rejection of such antennas for tanks and some aircraft. If one could design a wideband antenna for this band at 10"×32"×32" or 10,240 cubic inches, then there is enough real estate on the vehicle due to a volume reduction of 3.7:1.

Another antenna related problem is one that is typical of cell phone antennas. First, one needs a compact wideband antenna that can cover the cellular band at 800 MHz, and the PCS bands at 1.7–1.9 GHz, as well as operating at the GPS frequency of 1.575 GHz. Getting a meander line loaded antenna to operate down to 800 MHz at the current size required is a challenge.

Moreover, there is another problem that needs to be resolved with wideband cellular antennas. Since most cell phone antennas are backed with a ground plane, usually the ground plane of the printed circuit board within the cell phone, there is a problem called "down firing", in which the major lobe of the antenna points into the ground. This limits the ability of the hand held device both in the receive and in the transmit mode because radiation transmitted from such a device is fired into the ground, whereas the receive characteristic is diminished in the horizontal direction. While meander line loaded antennas have been used in cell phones because of their small size and wide bandwidth operating in the 800 MHz, 1.7 GHz and 1.9 GHz bands, they nonetheless suffer from "down firing" at frequencies above 1.7 GHz. It would be convenient if some meander line structure could also eliminate the down firing problem.

As part of the subject invention, a standard slow wave meander line structure is provided with a top shield. This has a number of important effects. First, the resonant frequency of the device is significantly lowered, which means that its low frequency cutoff is likewise lowered. Secondly, the effective radiation pattern of a meander line loaded antenna has a major horizontal lobe unaffected by ground planes in a wireless device regardless of operating frequency, thus to eliminate down firing. Thirdly, if one wishes to have a frequency switched meander line structure, voltage stress on the switches can be reduced.

As defined herein, a modified slow wave meander line structure that can be used as a coupling mechanism for 4 MHz transmissions without increasing its size, can be used as a wideband antenna for the 30–88 MHz applications, and can be used as a wideband cell phone antenna having a low cutoff frequency down to 800 MHz. The modified slow wave meander line structure also eliminates the ground plane "down firing" problem and eliminates switch stress in frequency switched meander lines.

Shield Structure

To do this, a standard meander line structure having a conductor plate is provided with a top shield over the structure, with the shield being coupled to the conductor plate. The top shield lowers the operating frequency of a meander line by affecting the propagation constant of the meander line structure. The propagation constant relies on the number of high impedance/low impedance transitions per unit length. This characteristic is the result of the fact that each transition causes a fixed phase shift. The more phase shift per unit length, the more delay per unit length. When utilizing a top shield connected to the conductor plane, there are more phase shifts per unit length and therefore more delays per unit length. Put another way, with the same size meander line structure, its effective length is increased which lowers its operating frequency. The top shield thus provides a double-sided device that has double the number of transitions per unit length such that more delay is accrued.

What in essence is happening with the use of the top shield is that it turns what was a low impedance section between two high impedance sections into a high impedance section between two low impedance sections thus, when utilizing the top. shield, the high impedance sections are now the vertical segments or sections of the meander line. The horizontal sections become the low impedance sections. If switches are put in these high impedance sections to switch the operating frequency of the meander line, then the switching stress is reduced. This means that the voltage differential across the switch is much decreased, it being from one low impedance section to another low impedance section. Thus, with the top shield an added advantage is that higher power communications can be achieved without switch burn out.

In order to provide such a dramatic break through it has been found that providing a grounded shield over this standard meander line structure significantly reduces the low frequency cutoff of the device without altering its size. The shield does so by changing the high/low impedance sections to one where the high impedance section is between two low impedance sections. Also, any switching is now done between two low impedance sections which drastically reduces voltage stress.

In one embodiment, the unshielded meander line when used as a coupler has a resonant frequency of 5.2 MHz, while the shielded meander has a resonant frequency of 4.05 MHz.

In summary, a standard slow wave meander line having sections of alternating impedance relative to a conductor plate can be provided with a top shield connected to the conductor plane for the purpose of lowering the resonant frequency of narrow band antennas and lowering the low frequency cutoff limit of wide band antennas. This is due to a higher delay per unit length occasioned by the use of the top shield.

The shielded meander line may be utilized as a coupling device to truncated antennas such as a whip antenna or grounded loop antenna for the purposes of loading the antenna so as to provide lower frequency performance. Since the propagation constant of the meander line structure depends upon the number of high impedance/low impedance transitions per unit length, the utilization of the top shield results in more phase shifts per unit length and thus more delay per unit length, with the symmetric double sided version having double the number of transitions per unit length. When configured to provide a miniature antenna for use in wireless handsets, the utilization of the top shield both lowers the cutoff frequency and eliminates down firing typical of wireless phone antennas due to the ground plane effect. Moreover, the top shield provides a uniform low VSWR over wide bandwidths and by virtue of lowering the operating frequency solves a skip-induced blackout problem due to the lower frequencies that can now be used. Further, for frequency switched meander lines, voltage stress is reduced by using the top shield. Finally, reducing the volume requirement by over 30% permits mobile use where real estate is at a premium.

BRIEF DESCRIPTION OF THE DRAWINGS

These and other features of the subject invention will be better understood in connection with a Detailed Description, in conjunction with the Drawings, of which.

DETAILED DESCRIPTION

Figure 1:
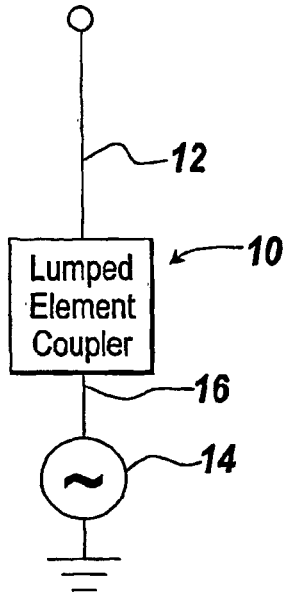
Fig. 1 (Prior Art)
FIG. 1 is a block diagram of a prior art lumped element coupler, coupling a monopole antenna to a signal source.

Referring now to FIG. 1, a conventional lumped element coupler 10 is coupled between a monopole or whip antenna 12 and a signal source 14 coupled between the coupler and ground. As mentioned hereinbefore, whether the lumped element coupler involves pi networks or T networks, each of these networks involves discrete elements in the form of a coiled inductor and a capacitor. Typically, the lumped element couplers act by changing the inductance or capacitance to match the impedance of the antenna to a particular transmission line, here shown at 16. In the case of inductors, the inductors are tapped at various points either mechanically or through switching circuits, whereas the capacitors may be made variable either. by a variable plate or by switching in and out a number of capacitors to provide for the appropriate coupling of the antenna to the transmission line.

Figure 2A:
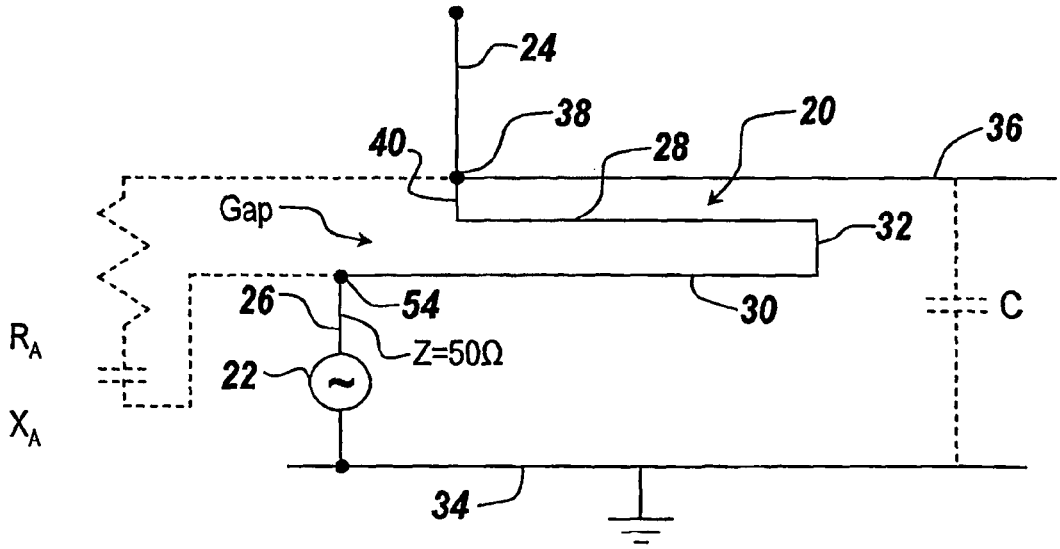
FIG. 2A is a schematic illustration of the subject meander line antenna coupler showing the meander line coupled to a monopole antenna, also illustrating the capacitance between the top plate and ground and the impedance of the antenna across the gap.

Rather than utilizing a lumped element coupler and referring now to FIG. 2A, what is shown is the use of a meander line 20 as an antenna coupler which is interposed between a signal source 22 and a monopole or whip antenna 24. The meander line in one embodiment has switched sections that enable it to vary its impedance which, when coupled in parallel with the impedance of the antenna, are such as to match the impedance at the base of the whip or monopole with the impedance of transmission line 26.

As illustrated schematically, meander line 20 is composed of a number of folded legs or sections 28 and 30, joined by an upstanding portion 32, with the meander line exhibiting a slow wave function due to the discontinuities and the impedances of the meander line. The meander line has a ground plate 34 to which one side of signal source 22 is coupled, and a top plate 36, as illustrated. It is noted that the base of antenna 24 is connected to the meander line at a point 38, which is the juncture of an upstanding portion 40 of meander line 20 and top plate 36.

As illustrated, there is a capacitance between top plate 36 and ground, as illustrated by C, whereas the impedance of the antenna at point 38 is illustrated by a resistive component, $R_A$, and a reactance component, illustrated by $X_A$.

Figure 2B:
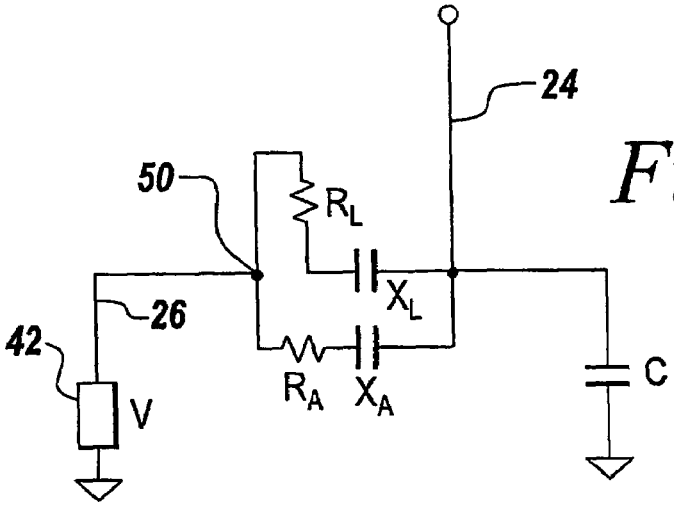
FIG. 2B is a equivalent circuit for the couple of FIG. 2A illustrating the parallel connection of the meander line impedance with the antenna impedance so as to present an adjusted antenna input impedance to the transmission line.

Referring to FIG. 2B, the equivalent circuit for the meander line coupler and antenna of FIG. 2A indicates that there is a voltage source to ground at 42 coupled to the junction of parallel connected impedances formed by $R_L$ and $X_L$ for the meander line and $R_A$ and $X_A$ for the antenna. The capacitance of the top plate to ground C is as noted.

As will be described hereinafter in rigorous detail, it has been found that the. meander line segments can be connected together in such a way that $R_L$ and $X_L$, when connected in parallel with $R_A$ and $X_A$, result in an impedance at point 50 which matches the impedance of transmission line 26.

Figure 3A:
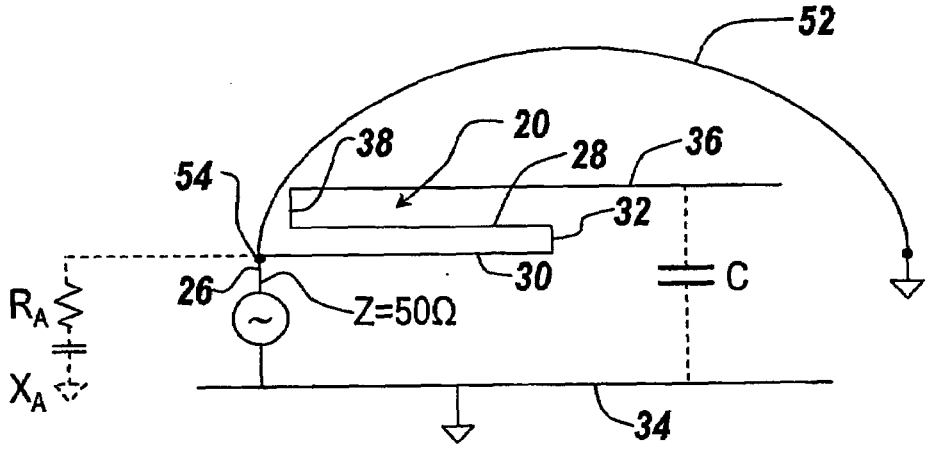
FIG. 3A is a schematic diagram of the subject meander line antenna coupler showing the meander line coupled to a loop antenna, showing one end of the loop coupled to the signal source side of the meander line.

Referring to FIG. 3A, in this case a loop antenna 52 is coupled between a point 54 and ground, with point 54 being the distal end of meander line leg or section 30, with like reference characters referring to like components between FIGS. 2 and 3. It will be noted that the difference between the connection of the meander line coupler in FIGS. 2 and 3 is that for monopole or vertical antennas therein bases are coupled at point 38, whereas four loop antennas, one end of the loop is coupled at point 54.

Figure 3B:
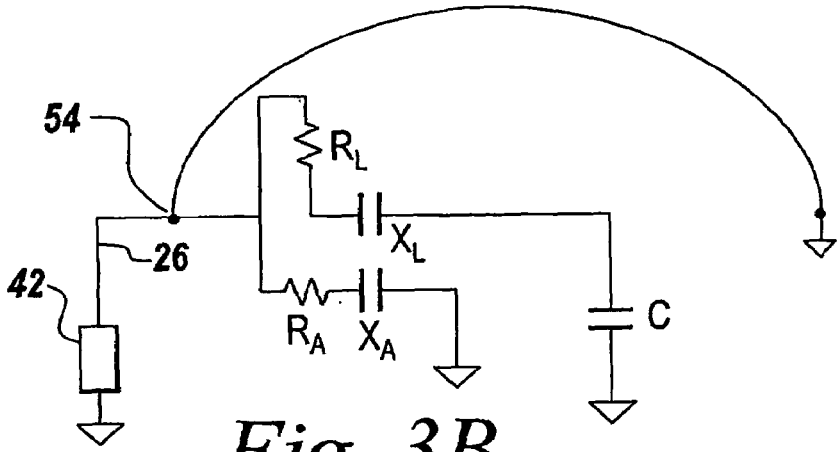
FIG. 3B is an equivalent circuit for the couple of FIG. 3A showing the parallel connection of the meander line impedance with the antenna impedance, also illustrating the connection of one end of the loop to the signal source side of the meander line.

Again with respect to the loop antenna and referring now to FIG. 3B, the meander line impedance composed of $R_L$ and $X_L$, is effectively connected in parallel to the impedance at the input of the antenna, namely $R_A$ and $X_A$, such that, for a variable length meander line, the meander line impedance in parallel with the antenna input impedance at point 54 can be made to match that of the transmission line. It is noted that the impedance of the normal coaxial transmission line used is 50 ohms.

Figure 4:
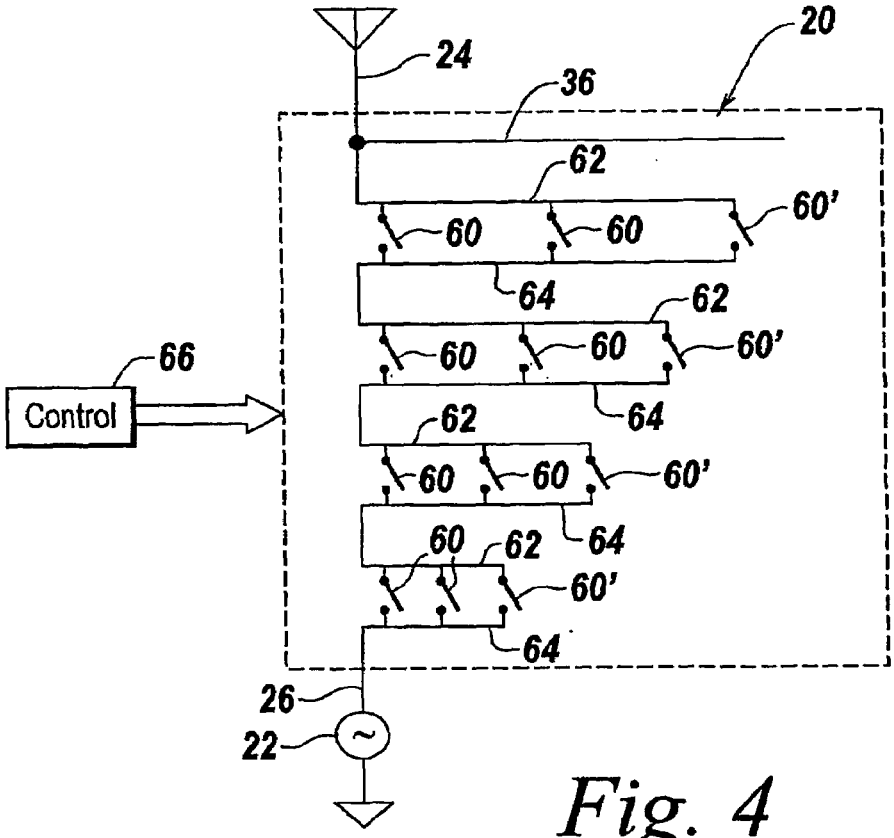
FIG. 4 is a diagrammatic illustration of the subject antenna coupler, showing a series of folds in a meander line with shorting switches or opening switches at various points in the folded meander line structure so as to be able to switch in and out various segments of the meander line.

Referring to FIG. 4, how the impedance of the meander line is changed or altered is shown through the utilization of solid state switches 60 interposed between folded portions 62 and 64 of various adjacent meander line segments. By virtue of closing or opening of these switches, various lengths of meander line are connected between antenna 24 and source 22, with the length of meander line corresponding to a variable length transmission line utilized in matching antenna 24 to transmission line 26.

These switches are typically solid state and under the control of a circuit 66 that is programmed to selectively activate certain of these switches to control the effective length of the meander line and its impedance.

In general, the use of the meander line results in relatively low currents existing within the meander line such that the switches themselves may not be as robust as, for instance, those switches that are utilized in lumped element couplers. Moreover, as illustrated by switches 60', one can locate theses switches at the high impedance low current nodes between the low impedance sections of the meander line so as to connect together various sections of the meander line without suffering loss through the switch.

Figure 5:
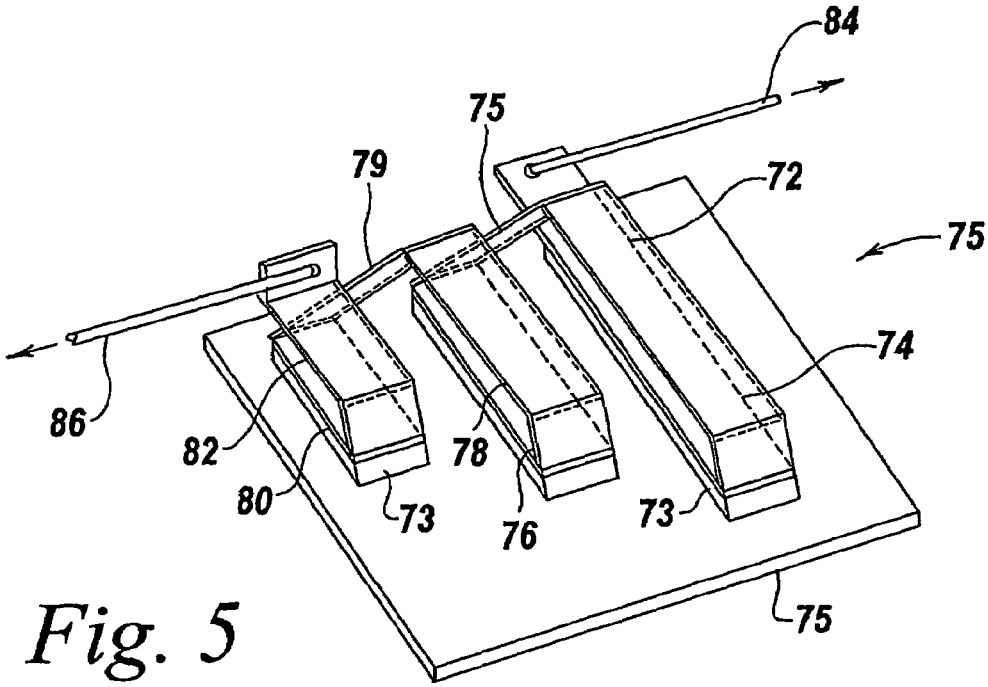
FIG. 5 is a diagrammatic illustration of one embodiment of a folded meander line structure capable of being adapted for antenna coupler use.

Referring to FIG. 5, a typical meander line suitable for use as a coupler includes a number of folded sections. Here a top section 72 meets a lower section 74, which is in turn coupled via a coupling conductor 75 to a lower section 76 of an adjacent meander line section. This section is in turn coupled to an upper portion 78 which is in turn coupled via a conductor 79 to a lower portion 80, in turn coupled to an upper portion 82. It will be noted that the upper and lower portions in one embodiment are made out of copper which is a tenth of an inch thick and which is one inch wide. The result is that, for these type of meander lines, there is very little resistance and therefore exceedingly low ohmic loss. It is noted that each of the folded sections lies on its own insulator 73 atop a ground plate 75. The connections to the meander line are illustrated at 84 and 86.

Figure 6:
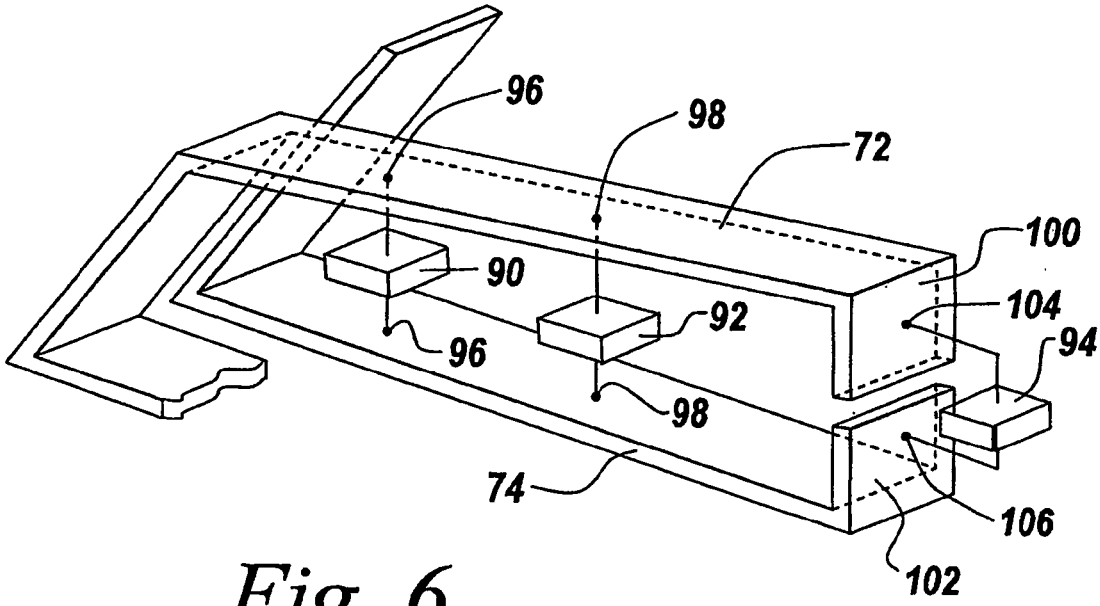
FIG. 6 is diagrammatic illustration of one segment of the meander line of FIG. 5, showing the interposition of a number of solid state switches to short out and to connect various sections of the meander line leg together.

Referring now to FIG. 6, a portion of the meander line of FIG. 5 is illustrated in which solid state switches 90, 92 and 94 are used to interconnect various portions or segments of the folded meander line. Here, solid state switches 90 and 92 serve to short out the meander line to foreshorten it at points 96 or points 98, whereas solid state switch 94 connects together what is a high impedance node for the meander line as illustrated by meander line sections 100 and 102 such that they are connected together by switch 94 at points 104 and 106.

By way of further explanation, the meander line antenna coupler, which includes a variable impedance transmission line, makes optimum use of the physical volume enclosed by the structure. The meander line antenna coupler is capable of being tuned by adjusting the length of the variable impedance transmission line. with switches.

As an example, an "L-shaped" meander line antenna coupler is the basic building block used in creating more complex meander line antenna coupler based arrays. The outstanding characteristic of the meander line antenna coupler is that near the resonant frequency, the current distribution along the vertical and horizontal plates is highly peaked at the gap. The gap region has been found to harbor a parallel resonance formed by the meander line and the distributed capacitance between the horizontal and vertical plates and the impedance of the external antenna $R_A$, $X_A$. Two different computer simulation codes (Sandia Tripatch, HFSS) have shown this characteristic.

It has been found that the meander line antenna coupler input impedance is the sum of the gap region impedance and the capacitance of the horizontal plate to ground. The meander line with its alternating high and low impedance sections is a fair approximation to a slow wave, non-dispersive transmission line with characteristic impedance equal to the geometric mean of the high and low impedances. The gap region is represented by an impedance, Z, which is the parallel combination of a) the impedance seen at the gap without the meander line attached and b) the meander line equivalent non-radiating transmission line. The impedance at the gap, which is the combination of the external antenna and the gap region, is measured or calculated with the aforementioned simulation codes. The capacitance of the horizontal plate is approximated by calculating the self-capacitance of the plate and applying a correction due to the proximity of the ground. The gap impedance is measured with the meander line antenna coupler in proximity but not directly connected to ground. Note that the meander line antenna equivalent circuit is valid only near resonance.

C is the horizontal plate capacity, $R_A$ is the antenna radiation resistance, $X_A$ is the antenna reactance, $R_L$ is the loss resistance in the meander line and $X_L$ is the reactance in the meander line.

The VSWR is low over the whole -tuning range, made possible because the input resistance at resonance is proportional to $X_C$ squared and inversely proportional to unloaded Q. As frequency increases these quantities decrease at the about same rate, thus keeping the input resistance constant. As will be shown, the exact form is:

$$Ro=\pi X_C^2(4ZoQu)$$

The meander line equivalent shorted line impedance is:

$$Zml = \frac{Zo}{\frac{R_L}{2Zo} - j/\tan\beta L_{eff}}$$

This is an approximation of a low loss shorted transmission line and is accurate as long as $\tan\beta L_{eff}$ is much greater than $R_L/2Zo$. Zo is the meander line impedance, $L_{eff}$ is the effective length of the line, and $\beta=\omega/c$.

The unloaded Q of the transmission line is $$Qu = \frac{\pi Zo}{2R_L}$$

The parallel combination of Zml and the antenna impedance $R_A+j\,X_A$ gives rise to the impedance function of the gap region:

$$Z = \frac{Zo}{\frac{Reff}{2Zo} - j/\tan\beta L_{eff} - jZo/X_A} \quad 1)$$

Where $Reff = R_L + 2R_A Zo^2/X_A^2$ $Qu = \frac{\pi Zo}{2Reff}$ and $MLA$ efficiency $= \frac{2R_A\ Zo^2}{ReffX_A^2} *$ mismatch loss Since one desires the impedance at the feed to be real, one sets the real part of Z (equation 1) equal to Ro, the yet to be determined input impedance. This results in the expression $$1/\mathrm{Tan}BL_{eff}+Zo/X_A=SQRT[\pi Zo/(4QuRo)] \quad 2)$$

The effective length of the meander line is determined by solving equation 2) for $\tan\beta\ L_{eff}$.

Inserting equation 2) in the expression for Z (equation 1), leads to the expression $$IMAG(Z)=\text{Imaginary part of } Z=SQRT(Qu\ Zo\ Ro4/\pi)$$

Setting IMAG(Z) to $-X_C$, to cancel out the horizontal plate capacity, the following relation is arrived at:

$$Ro = \frac{X_C^2\pi}{4ZoQu}$$

The above equation enables the VSWR to be calculated. It is revelatory to note that $X_C$ decreases with frequency and is in synchronism with Qu. This property accounts for the ability of the switched meander line to maintain a good match over frequency as the meander line is tuned to achieve resonance by shorting out combinations of sections of the meander line regardless of the arbitrary antenna used.

Shielded Meander line

Figure 7:
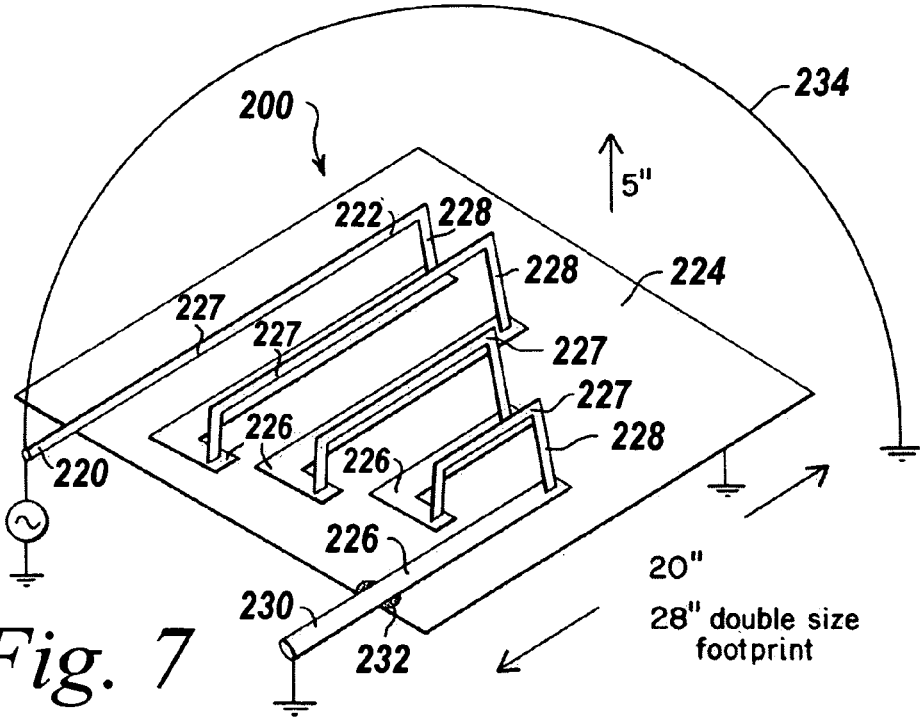
FIG. 7 is a diagrammatic illustration of the use of a standard meander line structure as a coupler to a grounded loop antenna.

Referring now to FIG. 7 and as described in U.S. Pat. No. 6,313,716, a slow wave meander line structure 200 is in the form of a folded transmission line 222 mounted on a plate 224. Plate 224 is a conductive plate, with transmission line 222 being optionally constructed from a folded microstrip line that includes alternating sections 226 and 227 which are mounted close to and separated from plate 224, respectively. This variation in height from plate 224 of alternating sections 226 and 227 gives these sections alternating impedance levels with respective to plate 224.

Sections 226, which are located close to plate 224 to form a lower characteristic impedance are electrically insulated from plate 224 by any suitable means such as an insulating material positioned therebetween. Sections 227 are located at pre-determined distance from plate 224, which predetermined distance determines the characteristic impedance of transmission line section 227 in conjunction with the other physical characteristics of the line as well as the frequency of the signal being transmitted over the line.

As illustrated, sections 226 and 227 are interconnected by sections 228 of the microstrip line which are mounted in an orthogonal direction with respective to plate 224. In this form the transmission line 222 may be considered as a single continuous folded microstrip line.

Note that one end of the meander line is illustrated by reference character 220, whereas the other end of the meander line is illustrated by reference character 230. Moreover, in one embodiment end 230 is electrically coupled to plate 224 as illustrated at 232.

In one embodiment, end 220 of the meander line may be connected to a grounded loop radiating element 234. This loop is grounded at one end, with the combination providing a narrow band antenna arrangement.

When operated at 4 MHz, the dimensions of such a unit is on the order of 50.4"×28"×10". For most mobile and aircraft applications, this footprint is double the desired size. As described above, what was needed was a breakthrough which would reduce the size of the footprint in half such that one embodiment with the subject top shield to be described, the footprint is now 36"×20"×5". The reduction in size over the standard meander line loaded antenna is a result of the top shield over such a structure.

Figure 8A:
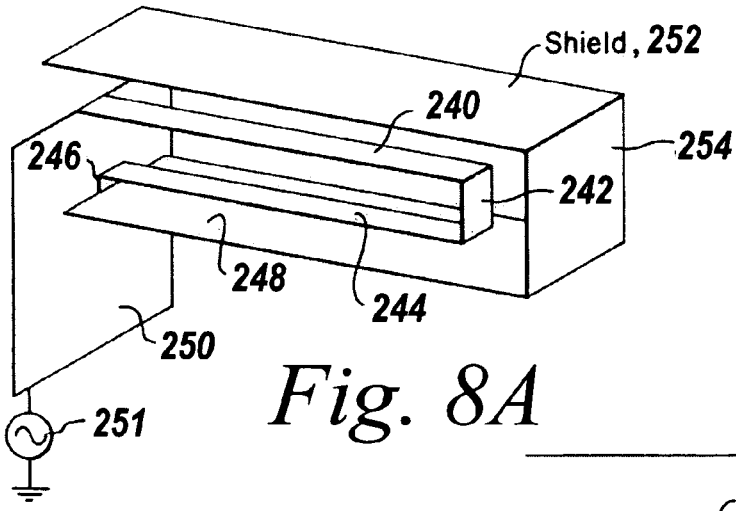
FIG. 8A is an isometric and schematic illustration of a shielded meander line structure illustrating the top shield.
Figure 8B:
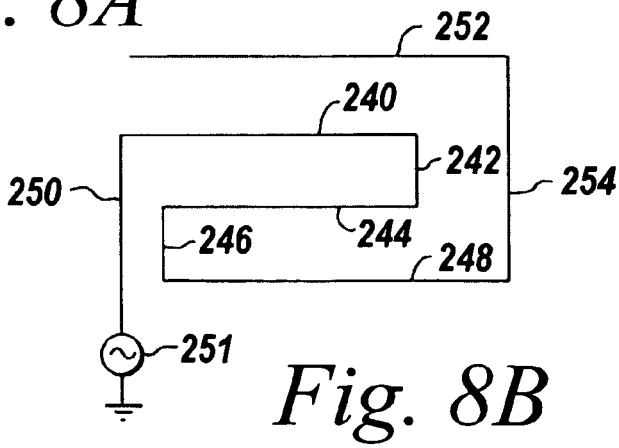
FIG. 8B is a schematic diagram of the meander line structure of FIG. 2A, showing the electrical connection of the top shield to the conductor plate of the meander line.

As will be seen in FIGS. 8A and 8B sections of alternating impedance relative to the conductor plate are provided with a top shield that lowers the operating frequency of the associated meander line. It does so by affecting the propagation constant of the meander line structure. The propagation constant relies on the number of high impedance/low impedance transitions per unit length. This characteristic is a result of the fact that each transition causes a fixed phase shift. The more phase shifts per unit length, the more delays per unit length. When utilizing the subject top shield connected to the conductor plate, there are more phase shifts per unit length and therefore more delays per unit length. This double-sided structure, thus, has double the number of transitions per unit length such that more delay is accrued.

As will be seen in FIGS. 9 and 10, when utilizing the top shield the high impedance sections are now the vertical segments of the meander lines. The horizontal sections therefore constitute the low impedance sections. The net result is that for the same footprint for the standard meander line structure, its effective length is doubled meaning that it can resonate at a lower cutoff frequency.

Referring now to FIG. 8A, in one embodiment such a meander line structure includes a top section 240 connected via a vertical section 242, in turn connected to a lower section 244 which is in turn connected via a conductive strip 246 to a bottom conductive plate 248. The meander line is fed via an upstanding plate 250 connected to a signal source 251 such that the signal is applied between ground and plate 250 to section 240 of the meander line. A top shield 252 is connected by an upstanding segment 254 to horizontal conductive plate 248, the effects of which will be described hereinafter.

Schematically and referring to FIG. 8B, top section 240 is connected by section 242 to lower section 244, which is in turn connected via conductive strip 246 to conductive plate 248 as illustrated. Plate 248 is connected via upstanding conductor 254 to shield 252 as illustrated, with the feed for the meander line structure being via upstanding plate 250 fed by signal source 251.

Figure 9A:
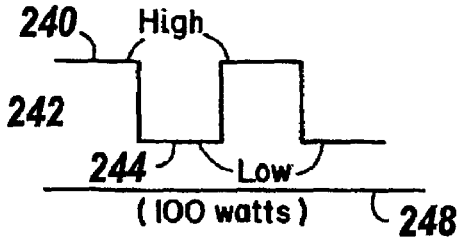
FIG. 9A is a waveform diagram illustrating the high and low impedance portions of a meander line structure.

Referring now to FIG. 9A, the diagram shows the relative impedances for the upper and lower sections of the meander line relative to conductor plate 248. Here it will be seen that the horizontally running upper section 240 is at a high impedance, whereas the lower section 244 is at a lower impedance. For extended meander line structures there is an alternation of high impedance and low impedance sections, with the number of sections being determined by the particular application.

Figure 9B:
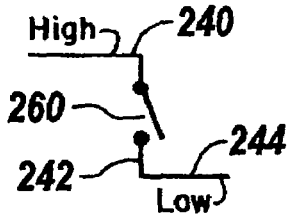
FIG. 9B is a schematic diagram of the interposition of a switch in the vertical transition between the high and low impedance sections of the meander line of FIG. 1 to be able to switch the operating frequency of the meander line, illustrating the high voltage stress on the switch due to the high to low impedance transition.

Referring to FIG. 9B, it can be seen that if the frequency of a meander line structure is to be changed, various sections may be switched into and out of the meander line. Here a switch 260 is interposed in the upstanding portion 242 which connects upper section 240 with lower section 244.

What will be seen is that the switch connects a high impedance section to a low impedance section. When the switch is open, there is significant voltage stress on the switch that may be from between 5,000 and 10,000 volts.

Here, if one wished to transmit 100 watts of power, then such a switching system could possibly be designed to tolerate the voltage stress. However, if one wanted then to increase the power of the transmitter from 100 watts to 300 watts, this could conceivably exceed the allowable voltage stress on the switch.

Figure 10A:
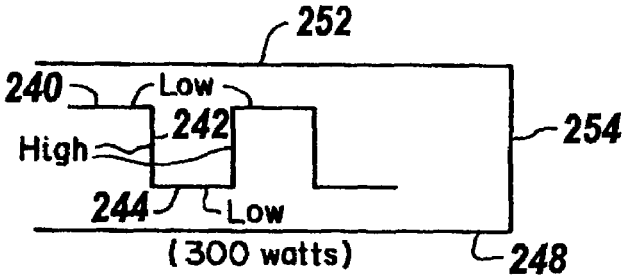
FIG. 10A is a waveform diagram of the result of providing a top shield on the impedance of the meander line segments illustrating a low impedance sector couple to another low impedance section through a vertical high impedance section, thus to double the number of impedance transitions. for a given length meander line.

Referring to FIG. 10A, if the structure of FIG. 9A were provided with top shield 252, then the result would be as follows:

Top section 240 would become a low impedance section, whereas upstanding section 242 would become the high impedance section. This high impedance section would then be connected to low impedance section 244 and so on.

What will be seen is that the relative impedances of the various sections of the meander line are altered with the use of a top shield. In a given length transmission line there would be double the number of high impedance/low impedance transitions when using the top shield.

Figure 10B:
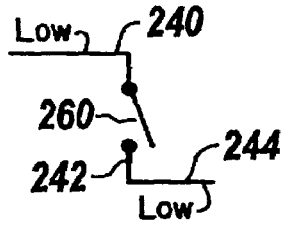
FIG. 10B is a schematic diagram of the interposition of a switch in the vertical high impedance transition between the low impedance sections of the meander line of FIG. 1 to be able to switch the operating frequency of the meander line, illustrating the a significant reduction in the voltage stress on the switch due to the low to low impedance transition.

Moreover, as illustrated in FIG. 10B switch 260 now connects a low impedance section 240 to another low impedance section 244 such that the voltage stress across switch 260 is minimized.

What this means is that when using a top shield there is considerably less voltage stress on the switches. This in turns translates into being able to handle increased output power from a transmitter.

Figure 11:
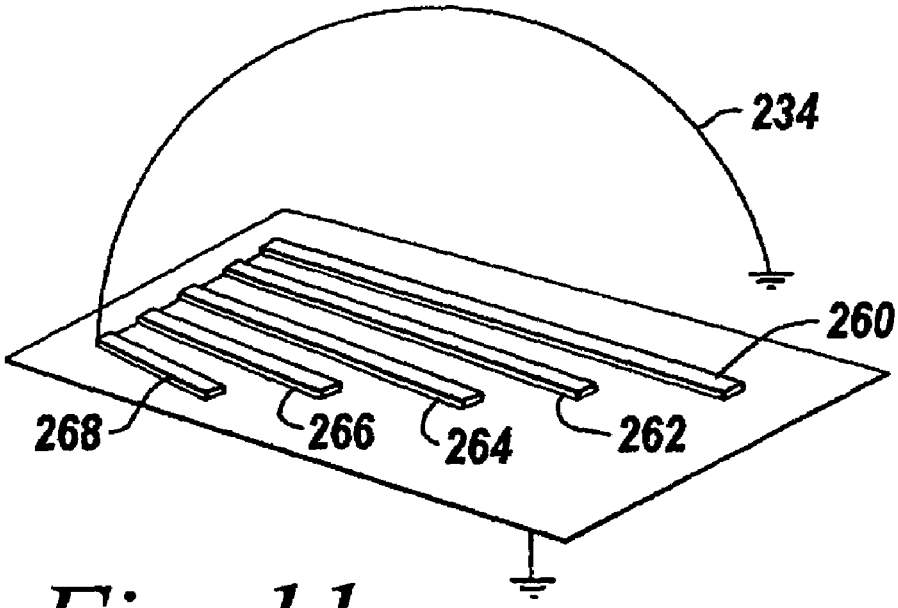
FIG. 11 is a diagrammatic illustration of a multiple section meander line used as a coupler to a grounded loop antenna.

Referring to FIG. 11, a slow wave meander line structure may include a number of sections 260, 262, 264, 266 and 268 which sections are connected together in general in the same manner as illustrated in connection with FIG. 7. When this device is utilized as an antenna coupler, grounded loop antenna 234 may be connected as illustrated.

Figure 12:
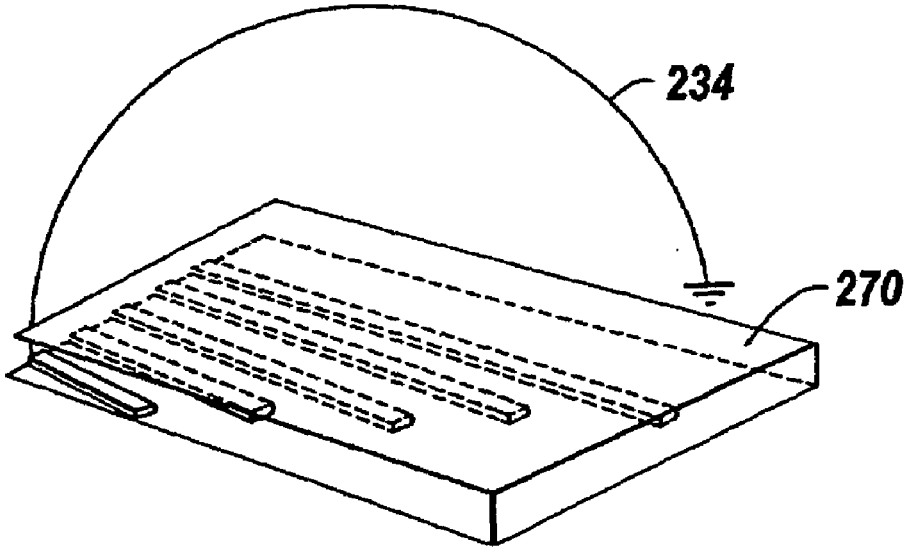
FIG. 12 is a diagrammatic illustration of the multiple section meander line coupler of FIG. 11, illustrating the use of a top shield to lower the low frequency cutoff of the meander line.

Referring to FIG. 12, when the structure of FIG. 11 is provided with a top shield 270, new characteristics make possible a lower cutoff frequency for the structure such that for a given size structure a lower cutoff frequency can mean the difference between communications and communications failure as will described in connection with FIG. 13.

Figure 13:
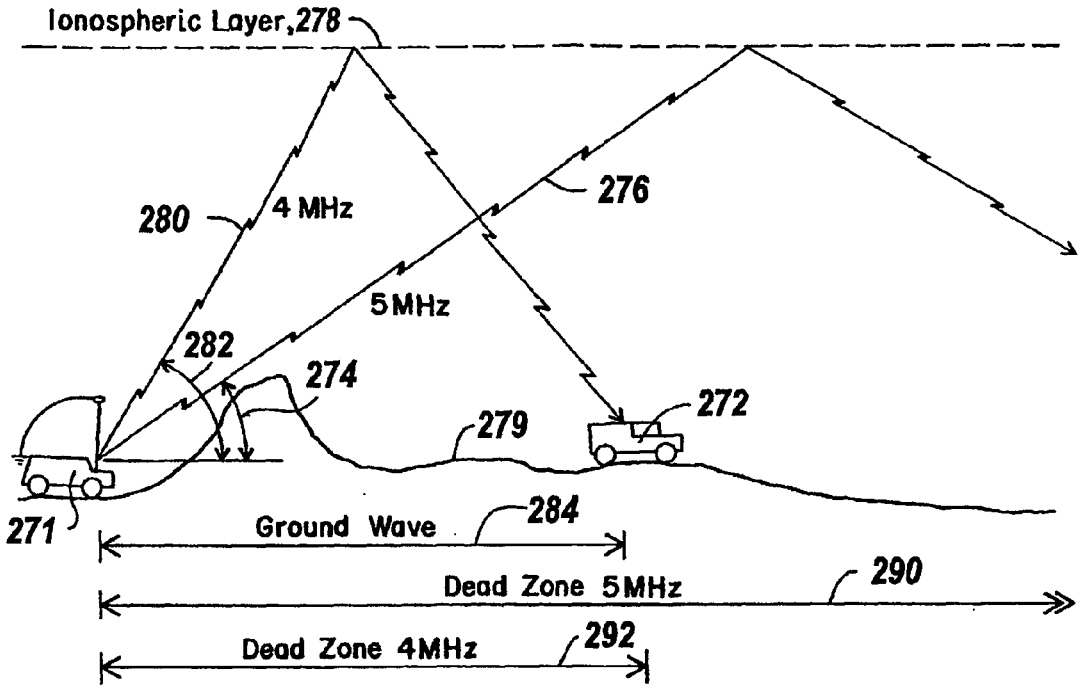
FIG. 13 is a diagrammatic illustration of a skip transmission scenario showing the effect of lowering the frequency of the transmission to eliminate a dead zone by increasing the take-off angle which decreases the skip distance.

As can be seen in FIG. 13, one operative embodiment of the subject invention involves a mounting of an antenna and coupler to a vehicle 271. Vehicle 271 carries a transmitter connected to the coupler. The purpose of utilizing the shielded embodiment of the coupler is such as to be able to establish communication between vehicle 271 and another vehicle 272 at some distance from vehicle 271.

Without the shield, a reasonably sized coupler and antenna can only be made to operate as low as 5 MHz. The result of the utilization of a 5 MHz carrier is that the takeoff angle 274 is shallow. This means that when radiation as illustrated at 276 is reflected by ionospheric layer 278, its point of impingement on the surface of the earth 279 is way beyond vehicle 272. In essence there is a skip-induced dead zone, the length of which is determined by the operating frequency of the transmitter.

If on the other hand utilizing the same sized coupler and antenna one could transmit at 4 MHz, then radiation as illustrated at 280 would be projected upwardly at a takeoff angle 282 which would result in communications with vehicle 272 at, for instance, a distance of 30+ miles. From a practical and tactical operational view point, communications between vehicle 271 and vehicle 272 can be achieved through the ground wave which dissipates at approximately 30 miles from the transmission source. The ground wave coverage is illustrated at 84. Skip or sky wave coverage then exists from 30 miles up to 100 miles.

What is accomplished by the utilization of a shielded meander line coupler is to provide a compact unit which can be vehicle-mounted and can establish communications from the transmit site by ground wave up to 30 miles and then by sky wave from 30 to 100 miles, thus eliminating the dead zone associated with operating at 5 MHz instead of 4 MHz. As can be seen, the dead zone at 5 MHz is illustrated by double ended arrow 290, whereas for 4 MHz the dead zone is illustrated by double ended arrow 292.

What can be seen is that by utilization of the shielded meander line structure, one can lower the low frequency cutoff of the coupler and antenna while at the same time providing for robust frequency shifting or switching at ever increasing transmit powers.

The subject shield meander line structure also has application in the 30 MHz–88 MHz range in which frequency hopping is utilized for covert operation.

Figure 14:
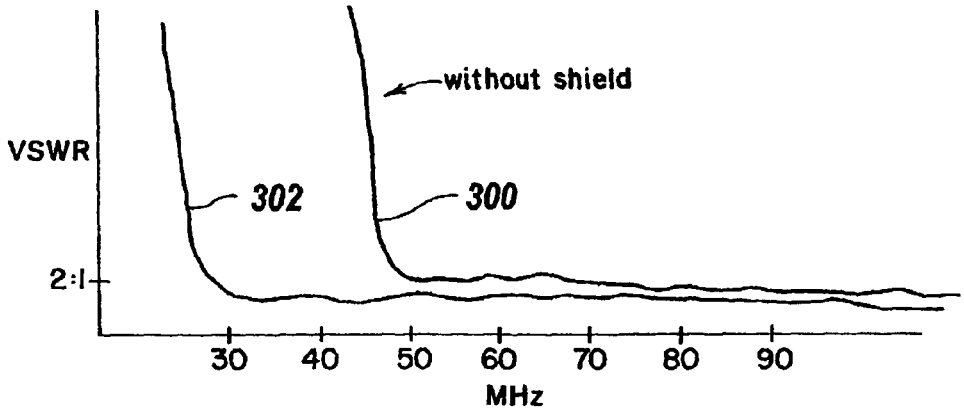
FIG. 14 is a waveform diagram of a compact meander line loaded antenna. operating in the 30–88 MHz band illustrating the VSWR with and without the use of a top shield.

Referring to FIG. 14, what is shown is a VSWR graph versus frequency which indicates by line 300 that the cutoff frequency for a suitably sized meander line structure is on the order of 45 MHz. However, with the shielded meander line structure, as illustrated by line 302 the VSWR is at a very acceptable 2:1 at 30 MHz. In this embodiment the meander line structure is indeed a broadband device which operates critically down to the 30 MHz lower end of this particular band.

Figure 15:
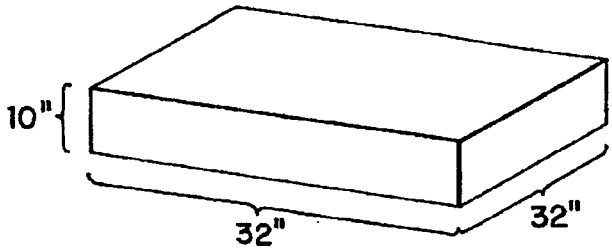
FIG. 15 is a diagrammatic illustration of the volume occupied by a meander line loaded antenna operating in the 30–88 MHz band illustrating the effect of using a top shield to reduce the volume to 10,000 square inches.

As illustrated in FIG. 15, a suitable meander line loaded antenna can be construed in a volume 32"×32"×10", whereas without the subject top shield, the meander line structure would have to be enlarged by double, unacceptable for mounting on aircraft or ground based vehicles.

The top shielded meander line structure is also of significant advantage when wide band antennas are to be utilized in wireless handsets.

Figure 16A:
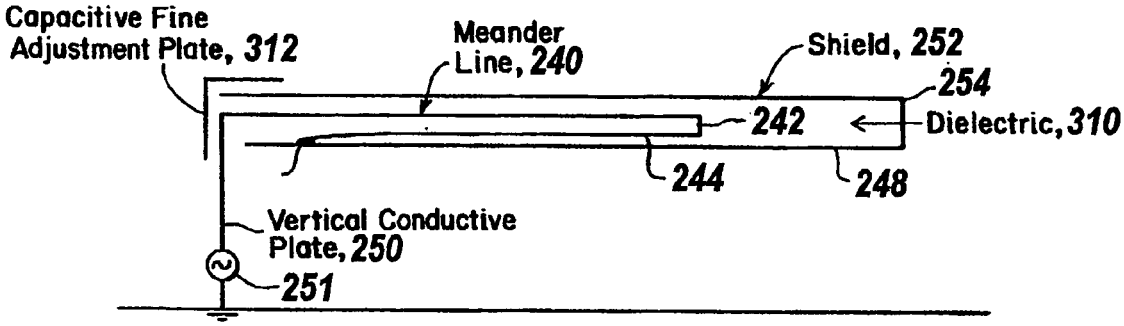
FIG. 16A is a schematic diagram of a meander line loaded antenna with a top shield for use as a wideband device for use in wireless handheld communications in which the top shield lowers the low frequency cutoff below the cellular band.

Referring now to FIG. 16A, a meander line loaded antenna is constructed from the aforementioned top section 240, upstanding section 242, lower section 244, conductor 246 and conductive plate 248, with top shield 252 being connected to plate 248 by upstanding member 254. The antenna is fed by a vertical conductive plate 250 as described above fed by signal source 251. The structure thus described is filled with dielectric material 310, with a capacitive fine adjustment plate 312 being positioned as illustrated.

The utilization of a wide band meander line loaded antenna for wireless hand held units achieves the benefit of compact size, in one embodiment 1.2"×1.2"×0.3", with a relatively low VSWR across not only the cellular band, and the PCS band as well as the GPS band, but also out to 6 GHz.

How this is accomplished is through the utilization of the meander line techniques described above in combination with the ability to lower the low frequency cutoff of the meander line loaded antenna. Were it not for the top shielding, the lowest frequency at which the antenna would radiate would be approximately 1750 MHz. This is clearly above the popular cellular band at 800 MHz.

Figure 16B:
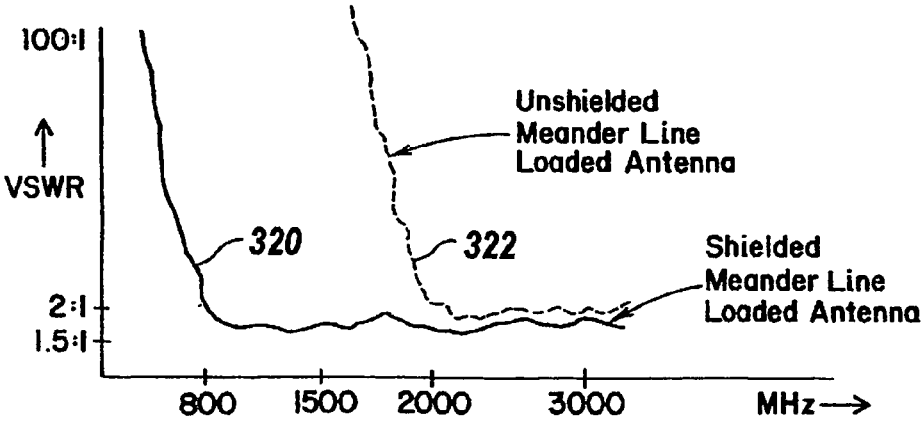
FIG. 16B is a waveform diagram illustrating the VSWR for the top shielded meander line loaded antenna of FIG. 10A, comparing it to the VSWR of an unshielded meander line loaded antenna of the same size.

By providing the top shield, the low cutoff frequency of the antenna is drastically reduced, which can be seen by the graph of FIG. 16B. Here, the VSWR is 2:1 at 780 MHz. As can be seen by line 320 the low frequency cutoff of such a wireless handset antenna in one instance is around 1750 MHz. However, by utilizing the shield, as illustrated by line 322, the VSWR can be maintained below 2:1 at 800 MHz.

Thus a compact wide bandwidth antenna is now available for handheld use in which the antenna may be embedded into the handheld unit.

Figure 17:
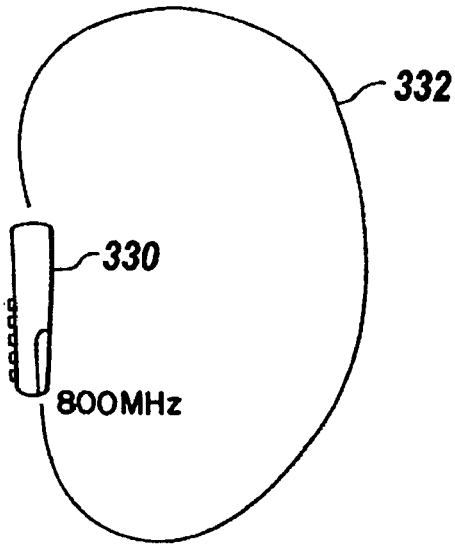
FIG. 17 is a diagrammatic illustration of the antenna lobe pattern for an internally carried antenna in a wireless handset for use in the 800 MHz band.

There is, however, an unusual result when utilizing the shielded meander line structure. As illustrated in FIG. 17 a standard handset 330 with an internal antenna has an antenna lobe 332 which looks like half a dipole. This is true for 800 MHz operation. However, and referring now to FIG. 18, for 1.9 gigahertz operation at PCS frequencies, the main lobe 332 is narrowed and points downwardly which is referred to as "down firing". This is due to the ground plane effect of the circuits within the cell phone and is directly related to the ground plane or planes utilized in the printed circuit board or boards within the cell phone.

Figure 19:
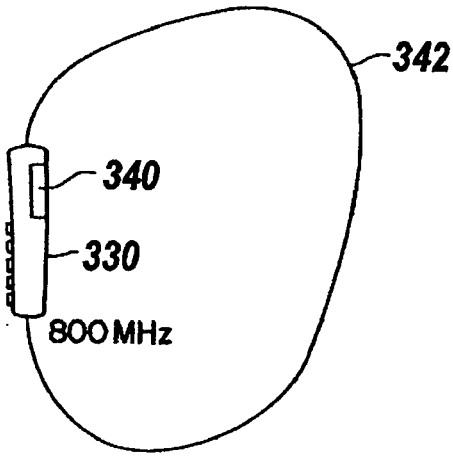
FIG. 19 is a diagrammatic illustration of the lobe structure for a meander line loaded antenna embedded into a wireless handset operating in the 800 MHz band; and, FIG. 20 is a diagrammatic illustration the antenna lobe pattern for an embedded meander line loaded antenna at 1.9 GHz having a top shield which eliminates any down firing ground plane effect.

Referring to FIG. 19, if handset 330 were to be provided with a wide band meander line antenna 340, then at 800 MHz the major antenna lobe would be a dipole type lobe 342.

Figure 18:
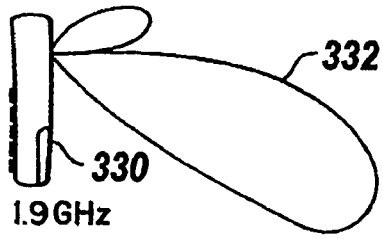
FIG. 18 is a diagrammatic illustration of the antenna pattern of an internally carried wireless handset antenna in the 1.9 GHz band showing a down firing pattern due to the ground plane effect caused by the ground plane of the printed circuit board or boards used in the wireless handset.
Figure 20:
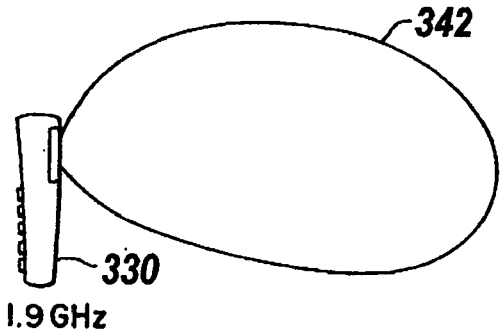

Referring to FIG. 20, were this handset operated in the 1.9 GHz region, the main lobe 342 while somewhat narrow would still be in the horizontal direction, thus eliminating the ground plane effect associated with the FIG. 18 embodiment.

What can be seen is that a compact wideband wireless handset and antenna can be achieved with a low cutoff frequency including all the bands of interest through the utilization of the top shield. Moreover, the utilization of the top shield in combination with the meander line loaded antenna provides the desirable horizontal lobe and eliminates down firing.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

what is claimed is:

1. An antenna tuner for coupling an antenna to a signal source so as to match the antenna input impedance to the transmission line between the signal source and the antenna, comprising:

a variable length meander line coupled to said antenna and said transmission line source; and, means for varying said meander line length until the antenna input impedance matches that of said transmission line.

2. The antenna tuner of claim 1, wherein said meander line includes a number of sections and wherein said means for varying said meander line length includes at least one switch connected between said meander line sections.

3. The antenna tuner of claim 2, wherein said switch shorts a portion of one meander line section to a portion of another meander line section.

4. The antenna tuner of claim 2, wherein said switch connects one meander line section to another meander line section.

5. The antenna tuner of claim 2, wherein said switch is a solid state switch.

6. The antenna tuner of claim 5, wherein said solid state switch includes a PIN diode.

7. The antenna tuner of claim 1, wherein said meander line includes a number of folded sections, one end of said meander line coupled to said transmission line and wherein said antenna includes a monopole antenna having a free end and an opposite end coupled to the other end of said meander line.

8. The antenna tuner of claim 1, wherein said meander line includes a number of folded sections, one end of said meander line coupled to said signal source, and wherein said antenna includes a loop antenna having one end grounded and an opposite end coupled to the end of said meander line coupled to said transmission line.

9. A method of matching the impedance of an arbitrary antenna to the impedance of a transmission line, comprising the steps of:

providing a variable length meander line having one portion coupled to the antenna and one end coupled to the transmission line such that the impedance of the antenna is in parallel with the impedance of the meander line; and, varying the length of the variable length meander line to function as a tuner until the impedance of the meander line and antenna matches the impedance of the transmission line.

10. The method of claim 9, wherein the meander line includes a number of sections and wherein the step of varying the length of the meander line includes the step of selectively interconnecting sections of the meander line.

11. The method of claim 10, wherein the step of selectively interconnecting sections of the meander line includes shorting out portions of different sections of the meander line.

12. The method of claim 10, wherein the step of selectively interconnecting sections of the meander line includes connecting together different meander line sections.

13. The method of claim 10, wherein the selective interconnecting step includes interconnecting different meander line sections at a high impedance node.

14. The method of claim 13, wherein the step of interconnecting different meander line sections at a high impedance node includes a solid state switch, whereby the load-carrying capabilities of the solid state switch can be minimized.

15. A method for providing a high gain antenna tuner, comprising the step of utilizing a variable length meander line as a lumped element antenna tuner, wherein the meander line tuner includes a solid state switch for interconnecting various meander line sections, whereby losses across the switch are minimized as compared to losses associated with solid state switches used in lumped element antenna tuners.

16. A method of providing a slow wave meander line with a lowered low-frequency cutoff, the meander line having a conductor plate and sections of alternating impedance relative to the conduction plate, comprising the step of:

providing a top shield over all of the meander line components, the top shield being electrically coupled to the conductor plate of the meander line and providing a lowered resonant frequency.

17. A meander line loaded antenna comprising:

a separate antenna;

a meander line having a conductor plate coupled to said antenna, and, a conductive shield over the top of the components of the meander line and electrically connected to said conductor plate, whereby the low frequency cutoff of said antenna is lowered.

18. A meander line having a reduced low frequency cutoff, comprising:

a meander line structure having a top section, an intermediate section, a bottom section, and a bottom electrically conductive element, and a shield over substantially all of said meander line structure and electrically connected to said bottom element.

19. A slow wave meander line having a conductor plate and sections of alternating impedances adjacent said conductor plate and a top shield connected to said conductor plate and positioned over substantially all of said sections of alternating impedances, said top shield lowering the resonant frequency of said meander line, whereby said meander line when coupled to a separate narrow band antenna lowers the resonant frequency of said narrow band antenna and when coupled to a separate wide band antenna lowers the low frequency cut off of said wide band antenna.

20. The meander line of claim 19, wherein said meander line has a number of sections creating a number of phase shifts and wherein said top shield increases the number of phase shifts associated with said meander line sections, thus creating more meander line delay.

21. The meander line of claim 19, and further including a separate antenna coupled thereto, said meander line functioning as an antenna tuner.

22. The meander line of claim 21, wherein said antenna has a distal end and wherein said distal end is grounded.

23. A method for eliminating down firing of an antenna carried by a wireless handset, comprising the step of embedding in the handset a slow wave meander line having a conductor plate, a top shield coupled to the connector plate, and a separate antenna coupled to the meander line.

24. The method of claim 23, wherein the antenna is a wide band antenna.

25. The method of claim 24, wherein the antenna operates above 1.7 gigahertz and eliminates down firing above the 1.7 gigahertz frequency.

26. An antenna for use in the 30 to 80 megahertz band, comprising:

a wide band slow wave meander line antenna having a conductor plate and a low frequency cutoff below 30 megahertz, wherein said meander line antenna includes a top shield electrically connected to the conductor plate thereof, said shield responsible for the lowering of the low frequency cutoff of said wideband antenna.

27. A method for reducing voltage stress in a frequency-switched meander line having a conductor plate, high-impedance horizontal sections, low-impedance upstanding vertical sections between two adjacent high-impedance horizontal sections, and a switch interposed in an upstanding section of the meander line between two adjacent horizontal sections, comprising the step of providing a top shield for the meander line over substantially all of the meander line sections and connected to the conductor plate thereof, whereby, with the shield in place, the top shield converts high impedance horizontal sections to low impedance sections, and the low impedance section to a high impedance section, the switch being in the high impedance section between the low impedance sections.

* * * * *